US011524216B2

(12) United States Patent
Parsons

(10) Patent No.: US 11,524,216 B2
(45) Date of Patent: Dec. 13, 2022

(54) FOLDABLE GOAL FRAME

(71) Applicant: QUICK PLAY SPORT LTD, Sheffield (GB)

(72) Inventor: William Parsons, Sheffield (GB)

(73) Assignee: QUICK PLAY SPORT LTD, Holbrook Sheffield (GB)

( * ) Notice: Subject to any disclaimer, the term of this patent is extended or adjusted under 35 U.S.C. 154(b) by 0 days.

(21) Appl. No.: 17/052,730

(22) PCT Filed: May 3, 2019

(86) PCT No.: PCT/GB2019/051232
§ 371 (c)(1),
(2) Date: Nov. 3, 2020

(87) PCT Pub. No.: WO2019/211621
PCT Pub. Date: Nov. 7, 2019

(65) Prior Publication Data

US 2021/0205682 A1 Jul. 8, 2021

(30) Foreign Application Priority Data

May 4, 2018 (GB) ..... 1807398

(51) Int. Cl.
*A63B 63/00* (2006.01)

(52) U.S. Cl.
CPC ..... *A63B 63/004* (2013.01); *A63B 2210/52* (2013.01); *A63B 2210/54* (2013.01)

(58) Field of Classification Search
CPC ..... A63B 63/004
See application file for complete search history.

(56) References Cited

U.S. PATENT DOCUMENTS 3,540,726 A * 11/1970 Davis ..... A63B 69/0079 473/427
3,979,120 A * 9/1976 Dietrich ..... A63B 63/004 473/478

(Continued)

FOREIGN PATENT DOCUMENTS

CN 203790544 U 8/2014
CN 207041846 U 2/2018

(Continued)

OTHER PUBLICATIONS

Samba Aluminum Folding Goal, www.sambasports.co.uk/Samba-Aluminium-Folding-Goal/, archived by the Internet Archive on Nov. 29, 2016 (Year: 2016).*

(Continued)

*Primary Examiner* — Laura Davison
(74) *Attorney, Agent, or Firm* — Shumaker, Loop & Kendrick, LLP

(57) ABSTRACT

A goal frame for a goal apparatus, the goal frame including a crossbar member, a first and a second goalpost member, a support member, and a rotatable attachment member. Respective ends of the crossbar member are attached to, or are operable to attach to, a respective end of the first and second goal post members to form a goal face. The attachment of the respective end of the crossbar member to the end of the first goal post member forms a crossbar-goalpost corner portion of the goal face. The rotatable attachment member is attached to, or is operable to attach to, the goal face adjacent to the crossbar-goalpost corner portion. The rotatable attachment member is attached to, or is operable to attach to, an end of the support member. The rotatable attachment member is operable to rotate about the part of the goal face to which it is attached from a first position in which the attached support member extends outwardly from the (Continued)

goal face to a second position in which the attached support member extends along substantially the same plane as the goal face.

9 Claims, 5 Drawing Sheets

(56) References Cited

U.S. PATENT DOCUMENTS

| | | | | | |
|---|---|---|---|---|---|
| 5,580,064 | A | * | 12/1996 | Childers, Jr. | A63B 63/004 273/400 |
| 5,839,733 | A | * | 11/1998 | Meeks | A63B 63/004 273/400 |
| 2005/0189719 | A1 | | 9/2005 | Goldwitz | |
| 2012/0165139 | A1 | | 6/2012 | Leoni | |

FOREIGN PATENT DOCUMENTS

| | | | | | |
|---|---|---|---|---|---|
| DE | 202004012299 | U1 | | 10/2004 | |
| GB | 2297493 | A | * | 8/1996 | A63B 63/004 |
| GB | 2336322 | A | * | 10/1999 | A63B 63/004 |
| GB | 2460438 | A | | 12/2009 | |

OTHER PUBLICATIONS

Jaypro Folding Steel Soccer Goal, www.gophersport.com/sports/soccer/jaypro-folding-steel-soccer-goals, archived by the Internet Archive on Apr. 2, 2017 (Year: 2017).*

International Search Report (ISR) for PCT/GB2019/051232 dated Jul. 24, 2019 (4 pages).

Written Opinion for PCT/GB2019/051232 dated Jul. 24, 2019 (6 pages).

International Preliminary Examination Report (IPER) for PCT/GB2019/051232 dated Nov. 10, 2020 (4 pages).

* cited by examiner

FOLDABLE GOAL FRAME

FIELD

The present invention relates to a goal frame. More specifically, the present invention relates to collapsible goal frame for a goal apparatus.

BACKGROUND

Many sports such as football (soccer), hockey etc. utilise a structure having parallel upright goalposts and a crossbar extending between the upper ends of the goalposts to define a goal face. Such structures are usually permanent or semi permanent fixtures and are made from steel or other heavy and cumbersome materials. However, it is also known to provide portable goals that may be assembled on site prior to use and disassembled once use has ceased. In this manner, a location need not be permanently devoted to use as a sports field. Portable goals are particularly useful in training scenarios where it may be beneficial to have a large number of goals to train with, which can then be dismantled after use.

Portable goals known in the prior art often involve the use of tubular plastic materials to form the posts and crossbar which, while representing a saving on weight, can be complex and time consuming to disassemble into a storable configuration.

Therefore, there is a requirement for a portable goal having improved ease of disassembly to a storage configuration. It is therefore an object of aspects of the present invention to address one or more of the abovementioned or other problems.

SUMMARY

According to a first aspect of the present invention there is provided a goal frame for a goal apparatus, the goal frame comprising a crossbar member, a first and a second goalpost member, a support member, and a rotatable attachment member, wherein respective ends of the crossbar member are attached to, or are operable to attach to, a respective end of the first and second goal post members to form a goal face, wherein the attachment of the respective end of the crossbar member to the end of the first goal post member forms a crossbar-goalpost corner portion of the goal face, wherein the rotatable attachment member is attached to, or is operable to attach to, the goal face adjacent to the crossbar-goalpost corner portion, wherein the rotatable attachment member is attached to, or is operable to attach to, an end of the support member, and wherein the rotatable attachment member is operable to rotate about the part of the goal face to which it is attached from a first position in which the attached support member extends outwardly from the goal face to a second position in which the attached support member extends along substantially the same plane as the goal face.

According to a second aspect of the present invention, there is provided a goal apparatus comprising a goal frame according to the first aspect of the present invention and a net operable to be attached to the goal frame.

According to a third aspect of the present invention, there is provided a kit of parts for a goal apparatus comprising a goal frame according to the first aspect of the present invention and a net operable to be attached to the goal frame.

According to a fourth aspect of the present invention, there is provided a rotatable attachment member for goal frame as herein defined.

The rotatable attachment member may comprise a first attachment portion operable to form an attachment with a part of the goal face and a second attachment portion operable to form an attachment with the support member.

The first attachment portion may comprise an attachment collar comprising an aperture operable to receive a part of the goal face such that the rotatable attachment portion can rotate about the part of the goal face received, preferably the attachment collar is annular.

The second attachment portion may comprise a projection operable to be received by the support member, suitably to be inserted into the support member, such as to form a close fit attachment. Preferably the projection is operable to be inserted into a terminal end of the support member, more preferably such that when attached to the support member the projection extends substantially co-axially with the support member.

The rotatable attachment member may comprise a linker between the first attachment portion and the second attachment portion. Suitably the linker is curved. The linker may be flexible. Optionally, the linker may be rigid. The linker may be in the form of a ribbon that has a lateral width that is significantly greater than the vertical height, suitably a width:height of at least 5:1, preferably at least 10:1 or at least 15:1. The longitudinal length of the ribbon may be similar to the width of the ribbon, suitably length:width is between 5:1 to 1:5, such as 3:1 to 1:3 or 2:1 to 1:2. The height of the ribbon may be less than 5 mm, such as less than 3 mm or less than 2 mm.

The linker may comprise two or more discrete spaced portions extending between the first attachment portion and the second attachment portion, suitably two or more spaced ribbons.

Advantageously, the provision of a flexible linker between the attachment portions of the rotatable attachment member allows for the attachment member to accommodate a range of angles between the components of the goal frame.

The rotatable attachment member may be formed of plastic, such as polypropylene. Preferably, the first attachment portion, the second attachment portion and/or the linker is formed of plastic.

The crossbar member and goalpost members are preferably rigid. The crossbar member and goalpost member may be formed of plastic, suitably polypropylene.

The goal face comprises first and second upright portions extending below the crossbar-goalpost corner portions and a crossbar portion extending horizontally between the crossbar-goalpost corner portions. Preferably, the rotatable attachment member is operable to attach to an upper end of the upright portion.

The crossbar member and goalpost members may be reversibly attachable. Suitably, the crossbar member and goalpost members are operable to be reversibly attached directly or indirectly via a crossbar-goalpost attachment member.

The crossbar member, goalpost member and/or crossbar-goalpost attachment member may comprise cooperating attachment portions operable to form a reversible attachment between the crossbar member, goalpost member and/or crossbar-goalpost attachment member. Suitably, the cooperating attachment portions comprise a female attachment portion and a male attachment portion, wherein the female attachment portion comprises a bore and the male attachment portion comprise a projection operable to be received into the bore to form an attachment. The attachment may be close fit and/or the male attachment portion may comprise a resiliently deformable knob operable to engage with an aperture in the wall of the bore of the female attachment portion. Preferably, attachment of the goalpost member to the crossbar member, directly or indirectly, prevents rotation of the goalpost member.

Preferably, the crossbar member and the goalpost members are operable to be attached via crossbar-goalpost attachment members comprising two attachment portions. More preferably, the crossbar-goalpost attachment member comprises two male attachment portions operable to form a reversible attachment with female attachment portions in the crossbar and goalpost members. The crossbar-goalpost attachment member may be angled such that the attachment portions of the crossbar-goalpost attachment member are substantially perpendicular.

The first attachment portion of the rotatable attachment member, preferably a collar attachment portion, may be operable to receive a portion of the crossbar member, goalpost member and/or the crossbar-goalpost attachment member, such as a portion of the attachment portion of the crossbar member, goalpost member and/or the crossbar-goalpost attachment member, preferably a portion of a male attachment portion, more preferably a portion of a male attachment portion of the crossbar member or the crossbar-goalpost attachment member, most preferably of the crossbar-goalpost attachment member.

The goal face may comprise a flange operable to abut against the rotatable attachment member and hold it in position on the goal face. Preferably, the flange is the upper edge of the goalpost.

The collar attachment portion of the rotatable attachment member may be substantially flush with the adjacent outer face of the goal face when attached.

The support member is operable to attach to an upper end of the goalpost member, or upright, by attachment to the rotatable attachment member. Suitably, in the first position the support member is operable to support the goal face in a substantially erect position. The goal frame preferably comprises at least one rotatable attachment member and a support member per goalpost member/upright.

The goal frame may comprise a base member operable to attach to the lower end of the goalpost members, or upright, and support the goal face in an erect position. The base member may comprise first and second arms, wherein first ends of each arm are attached to, or is operable to attach to, a respective lower end of the first and second goalpost members such that the arms extend outwardly from the goal face. The arms and the respective goalpost member, or upright, are preferably reversibly attachable. The crossmember and the arms of the base member may be attached as defined herein in relation to the crossbar member and the goalpost member.

The base member may further comprise a crossmember operable to attach to, and extend between, the first and second arm members, suitably attach at respective ends of the crossmember to the second ends of the first and second arm members.

The support member may comprise a first and second end, wherein the first end is operable to attach to the rotatable attachment member of the goal face.

The base member may comprise an attachment portion operable to form an attachment with the second end of the support member, preferably the attachment portion is part of a further rotatable attachment member as defined herein operable to attach to a part of the base member, preferably operable to attach to, or adjacent to, a part of an arm of the base member.

The crossmember and the arms of the base member are preferably reversibly attachable. The crossmember and the arms of the base member may be attachable as defined herein in relation to the crossbar member and the goalpost member.

Advantageously, when the crossmember of the base member is detached from the arms of the base member, the arms and support member of the base member may be folded from the first position in which the arms and support member extend outwardly from the goal face and support the goal face in a substantially erect configuration to the second position in which the arms and support member extend substantially along the same plane as the goal face, without requiring rotation of the goalpost members or detachment of the support member or arm member. Thereby providing an easier to collapse goal frame.

Furthermore, the use of a rotatable attachment member at either end of the support member, in particular with the use of flexible linkers, enables the goal frame to tolerate a variation in angles between the members of the goal frame in use and therefore prolong the life of the goal frame. The same rotatable attachment member may also be used with goalpost, crossbar and base members of different sizes.

Further still, the separation of the support member attachment member from the goalpost member and crossbar-goalpost attachment member provides an easier and cheaper to produce goal frame.

The crossbar member, goalpost members, arms, crossmember and/or support member may comprise two or more discrete portions operable to be attached together to form the crossbar member, goalpost members, arms, crossmember and/or support member. The portions may be attached using attachment members and attachment portions as herein defined in relation to attachment of the crossbar member and goalpost member with the exception that the attachment member is preferably linear.

The net may be reversibly attachable to the goal frame. Suitably, the goal frame is operable to be collapsed with the net attached to goal frame, and preferable with the net attached to the crossmember of the base member.

References to "end" herein are not restricted to the terminal end, unless otherwise indicated. References to "end" mean toward an end, but preferably at the terminal end.

All of the features contained herein may be combined with any of the above aspects in any combination.

For a better understanding of the invention, and to show how embodiments of the same may be carried into effect, reference will now be made, by way of example, to the following figures.

BRIEF DESCRIPTION OF DRAWINGS

FIG. 1 shows a perspective view of an assembled goal frame 102 according to the present invention. Goal frame 102 comprises crossbar member 106, goalpost members 108, 110, base member 114 and diagonal support members 122, 124, wherein crossbar member 106 and goal post members 108, 110, form goal face 104, and the diagonal support members 122, 124 delineates a cavity behind the goal face 104. Net (not shown) is operable to attach to frame 102 such as to form a partial enclosure around the cavity of the goal frame.

Figure 1:
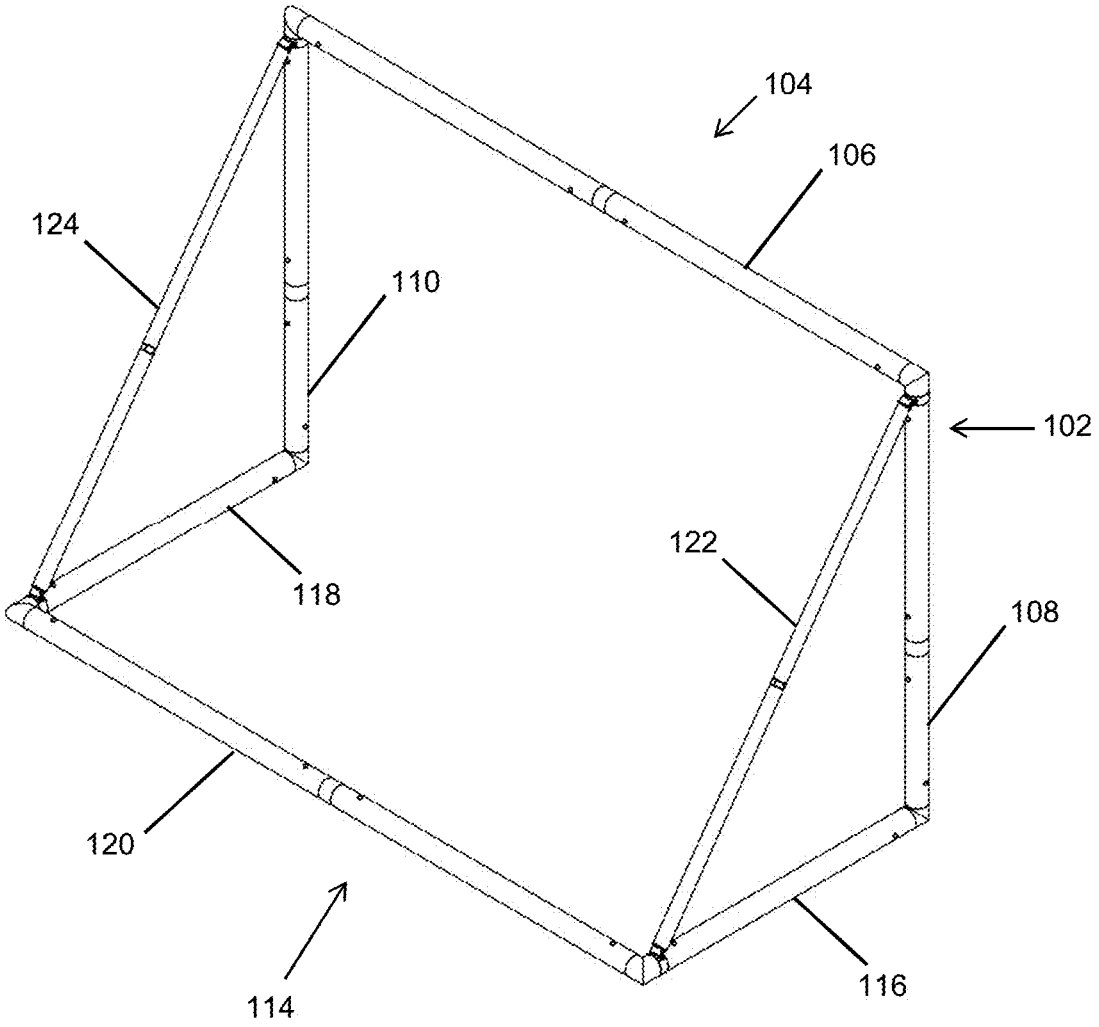
FIG. 1 shows a perspective view of an assembled and erect goal frame according to the present invention.

The base member 114 is formed from a series of reversibly attached linear inflexible hollow plastic cylindrical portions of variable size and length in the form of arm members 116, 118, and crossmember 120. Arm members 116, 118 each consist of a single inflexible portion, whereas the crossmember 120 consists of two inflexible portions 120*a, b* joined together by linear attachment member 126*a*.

The distal ends of crossmember 120 are each reversibly attached to arm members 116 and 118 by corner attachment members 128*a* and *b* to form a right angle at each corner attachment member with arm members 116 and 118 residing in a parallel planes to each other and extending in the same direction toward the lower end of goalpost members 110 and 108, respectively.

Goal face 104 comprises crossbar member 106 and goal post members 108 and 110. The crossbar member 106 and goal post members 108, 110 each consist of two inflexible hollow plastic cylindrical portions, wherein the two portions 106*a, b* are reversibly attached at proximal ends by a linear attachment member 126*d*, the two portions 108*a, b* are reversibly attached at proximal ends by a linear attachment member 126*b* and the two portions 110*a, b* are reversibly attached at proximal ends by a linear attachment members 126*c*.

The distal ends of crossbar member 106 are each reversibly attached to goalpost members 108, 110 by corner attachment members 128 *e, f* to form right angles at each corner member with goalpost members 108, 110 residing in parallel planes to each other.

The ends of arm members 116, 118 distal to the ends attached to the crossmember 120 and the lower ends of goal post members 108, 110 of goal area 104 are reversibly attached together by corner attachment members 128 *c, d* to form right angles at each corner member retaining the parallel relationship between opposing arm members 116 and 118, and opposing goalpost members 108 and 110.

Diagonal support members 122, 124 each consist of two inflexible hollow plastic cylindrical members which are reversibly attached by linear attachment members 126*e, f*. The diagonal support members are reversibly attached to the goal post member 108, 110 and arm member 116, 118 at opposed ends by post rotatable attachment members 132*a, b* and arm rotatable attachment members 134 *a, b* respectively. The post rotatable attachment members 132 are located at the top ends of goal post members 108, 110 (adjacent to crossbar member 106). The arm rotatable attachment members 134 are located at the rear end of arm members 116, 118 (adjacent to crossmember 120). The diagonal support members when attached form a triangular prism shape, providing rigidity to goal frame 102, specifically the goal face 104 in the erect position.

Figure 3:
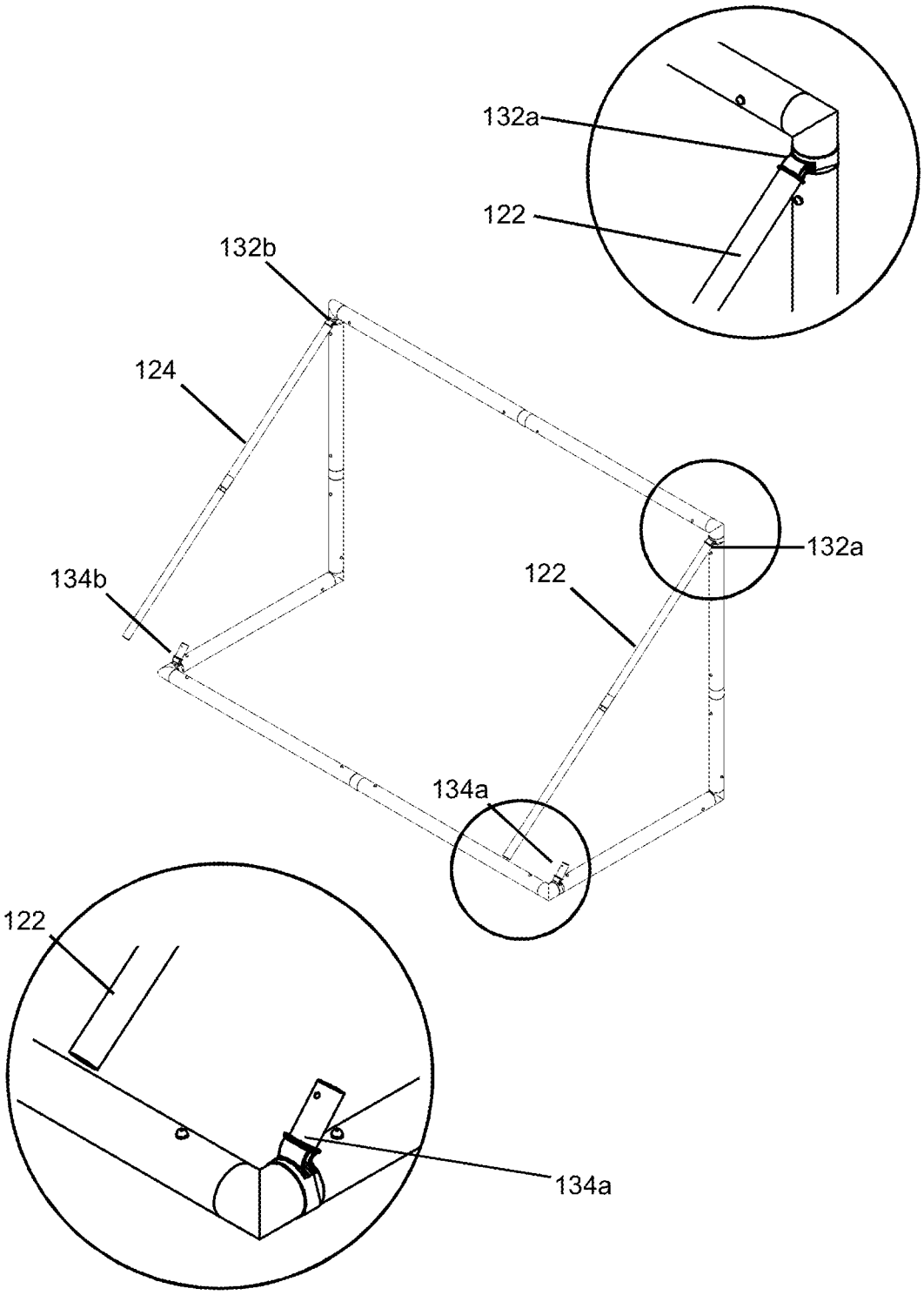
FIG. 3 shows a perspective view of the goal frame of FIG. 1 partly dissembled and enlarged views of the crossbar-goalpost corner portion and crossmember-arm corner portion.

FIG. 3 shows the goal frame 102 with the diagonal support members 122, 124 detached from arm collar attachment members 134*a, b*. Expansions are shown of the detached arm collar attachment members 134*a*, and the attached post collar attachment member 132*a*. Flexibility of the post and collar rotatable attachment members 132, 134 facilitates their detachment from diagonal support members.

Linear attachment members 126 and corner attachment members 128 comprise a central section 136. The central section 136 is the same diameter as the corresponding members to which the attachment members combine, for example, crossbar member 106, the linear attachment member 126*d* is the same diameter as crossbar members 106*a* and *b*.

Linear attachment member 126*d* comprises two male attachment portions which are able to respectively insert into an end of crossbar member 106*a* and *b*, the ends of which act as female attachment portions with a bore to receive the projection of the male attachment portion. The male attachment portions are smaller in diameter than the female attachment portions. The central section orientates the male attachment portions so that they are in a linear orientation The linear attachment member 126*d* comprises a discrete cuff 140 comprising a resiliently deformable knob 142. The cuff 140 resides within the bore of the male attachment portion and the knob extends through an aperture in the wall of the bore of the male attachment member. The bore of the female attachment member also comprise an aperture in the wall of the bore. When the male attachment portion is inserted into the female attachment member the knob is depressed by the wall of the bore of the female attachment portion until the knob aligns with the aperture of the female attachment portion at which point the knob extends through the wall of the female attachment portion to lock the attachment member to the crossbar member. When dissembling the goal frame, knob 142 is depressed, releasing the male and female attachment portions.

Figure 4A:
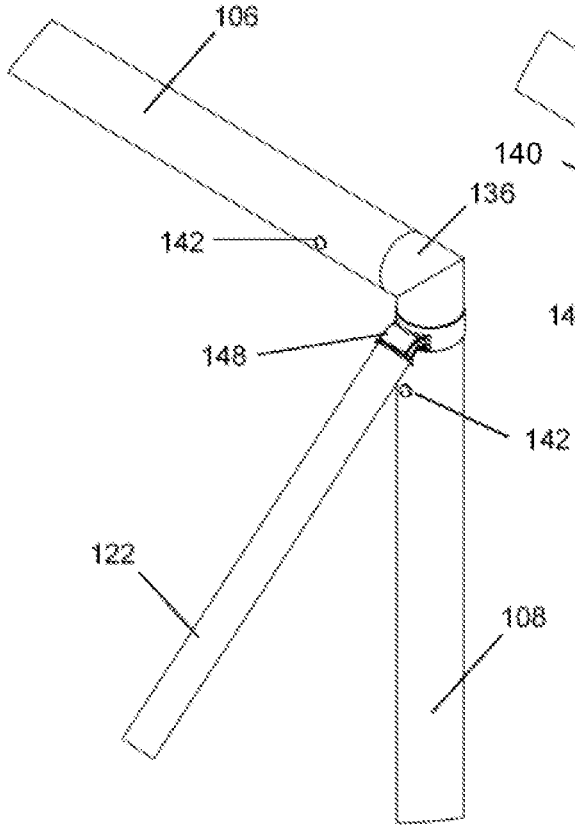
FIG. 4(A) shows enlarged perspective view and FIG. 4(B) an exploded view of the crossbar-goalpost corner portion of the goal frame of FIG. 1.
Figure 4B:
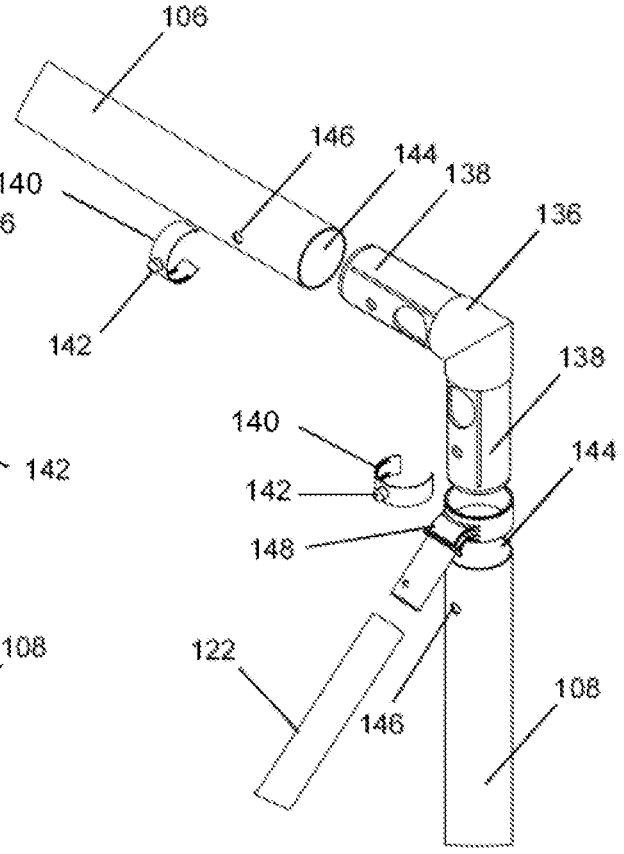

Corner attachment members are the same as linear attachment members, except the central section arranges the male attachment members 138 in a perpendicular orientation, resulting a corner attachment member as seen in FIGS. 4(A) and 4(B).

Figure 2:
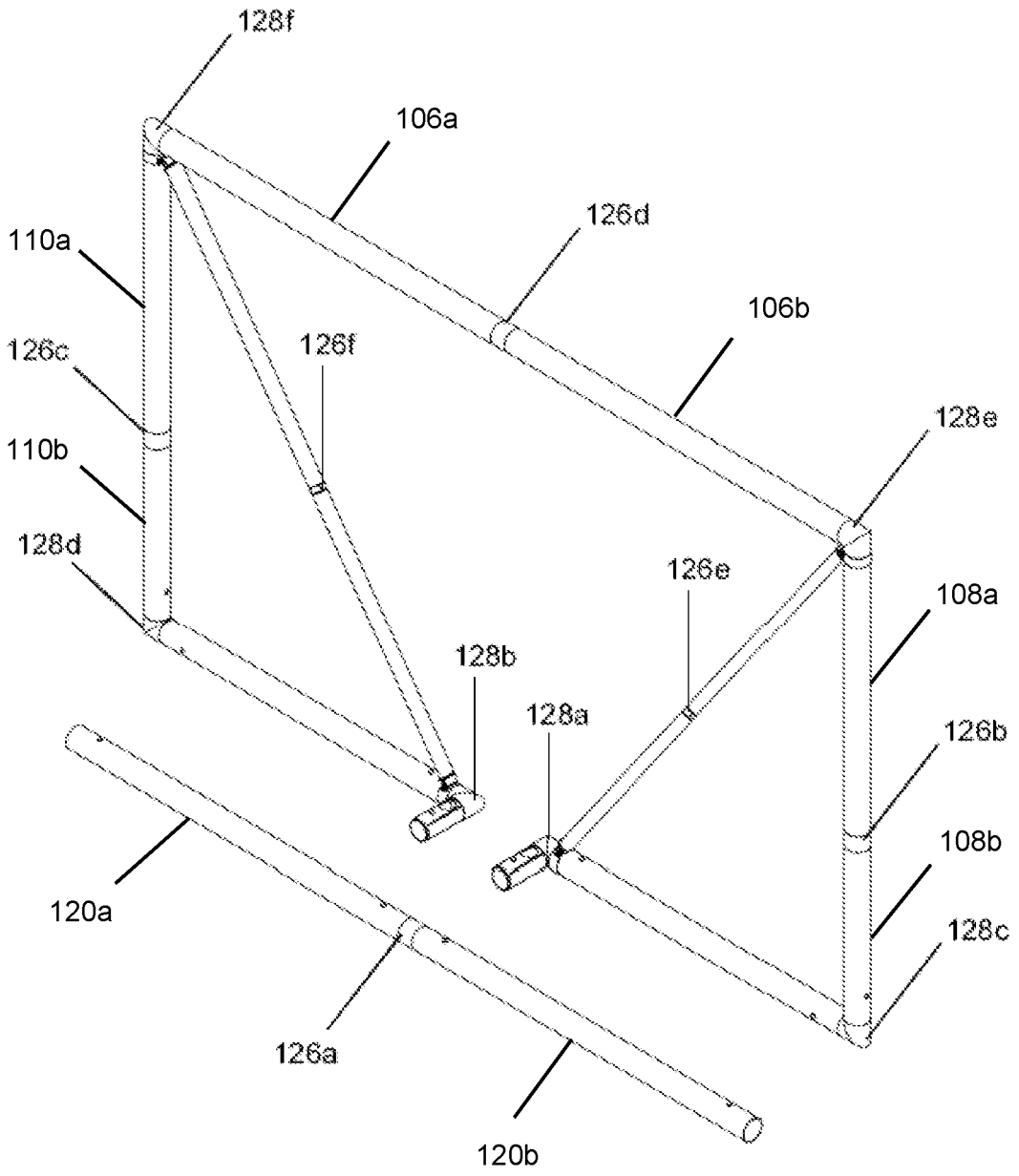
FIG. 2 shows a perspective view of the goal frame of FIG. 1 in the collapsed configuration.

Linear attachment members and corner attachment members allow the rotation of connected members. This can be seen in FIG. 2, where after detaching crossmember 120 from corner attachment members 128*a*, the corner attachment member 128*c* allows rotation about the goalpost member axis resulting in goalpost members 108, 110 and crossbar member 106, i.e the goal face, residing in substantially the same plane as arm members 116, 118 and support members 122, 124.

Figure 5B:
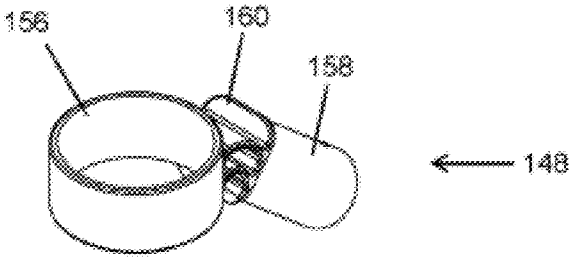
FIG. 5(B) shows a perspective view of rotatable attachment member 148 and FIG. 5(C) a side view of rotatable attachment member 148.
Figure 5C:
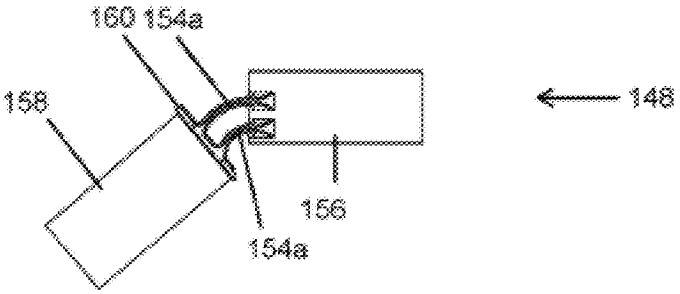
FIG. 5(A) shows a side view of the crossbar-goalpost corner portion of FIG. 4(A)
Figure 5A:
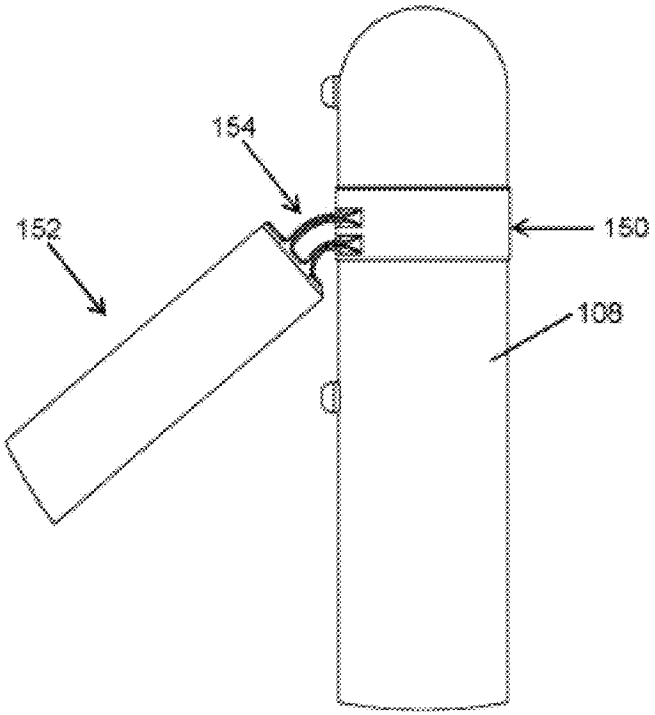

Post attachment member 132 and arm attachment member 134 comprise a rotatable attachment member 148 as seen in FIGS. 5(A), 5(B), and 5(C). Rotatable attachment member 148 comprises a first attachment portion 150, a second attachment portion 152, and a linker 154. The first attachment portion 150 and second attachment portion 152 are attached together by linker 154.

Linker 154 is a curved flexible material. This allows for facilitation of movement of the diagonal support members of the goal frame when being dissembled.

The first attachment portion 150 of post attachment member 132 comprises annular collar 156, which is similar in diameter as goalpost member 108. When assembling the goal frame, the male attachment member 138 of corner attachment member 128*e* is pushed through annular collar 156 and inserted into the female attachment member 144 of goalpost member 108. As the annular collar 156 is larger in diameter than the male attachment member, the annular collar can freely rotate about the axis of the goal post member. The lower face of the collar 156 sits on the upper edge of goalpost member 108 such that the upper edge acts as a blocking flange holding the attachment member 132 in position on the goal face.

When a post attachment member is present, the aperture in the adjacent goal post member is located higher in the female member when compared to, for example, the location of the aperture in the distal attachment portion of the goal post member. This is to facilitate the annular collar 156, whilst retaining the ability for the knob 142 to engage the aperture 146 as discussed above. This difference in aperture position can for example be seen in FIGS. 4(A) and 4(B), where the aperture of goal post member 108, is closer to the end of the female member than the corresponding aperture of crossbar member 106, which does not facilitate an annular collar.

The second attachment portion comprises male attachment member 158 and blocking flange 160. The male attachment member 158 reversibly attaches to the end of the diagonal support members 122, 124 by forming a close fit attachment. The end of diagonal support members 122, 124 are female attachment members, capable of receiving the male attachment member by the same method as described above. Blocking flange 160 is operable for the diagonal support members to abut against, preventing the male attachment member from entering the female attachment member too deeply.

The arm collar attachment members 134 are the same as the post collar attachment members 132, except they are located toward the rear of the goal frame, at the distal ends of arms 116, 118, adjacent to crossmember 120.

One post collar attachment member attaches to one side of a diagonal support member, and one arm collar attachment member attaches to the other side of the diagonal support member forming a triangular shape, which forms the sides of the goal frame.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A goal frame for a goal apparatus, the goal frame comprising a crossbar member, a first and a second goalpost member, corner attachment members, a support member, and a rotatable attachment member, wherein the corner attachment members are operable to reversibly attach respective ends of the crossbar member to a respective end of each of the first and second goalpost members to form a goal face, wherein the rotatable attachment member comprises a collar attachment portion, and wherein the collar attachment portion of the rotatable attachment member is operable to receive a part of one of the corner attachment members to attach the rotatable attachment member to the goal face, wherein the rotatable attachment member is attached to, or is operable to attach to, an end of the support member, and wherein the rotatable attachment member is operable to rotate about the corner attachment member from a first position in which the attached support member extends outwardly from the goal face to a second position in which the attached support member extends along substantially the same plane as the goal face and, wherein at least a portion of the collar attachment portion of the rotatable attachment member is substantially flush with an adjacent outer face of the goal face when attached to the goal face.

2. The goal frame according to claim 1, wherein the rotatable attachment member comprises a second attachment portion operable to form an attachment with the support member.

3. The goal frame according to claim 2, wherein the rotatable attachment member comprises a linker between the collar attachment portion and the second attachment portion.

4. The goal frame according to claim 3, wherein the linker is flexible.

5. The goal frame according to claim 3, wherein the linker is in the form of a ribbon.

6. The goal frame according to claim 3, wherein the linker comprises two or more discrete spaced portions extending between the collar attachment portion and the second attachment portion.

7. The goal frame according to claim 1, wherein the rotatable attachment member is operable to attach to an upper end of one of the goalpost members.

8. The goal frame according to claim 1, wherein the goal face comprises a flange operable to abut against the rotatable attachment member and hold the rotatable attachment member in position on the goal face.

9. A kit of parts for a goal apparatus comprising the goal frame according to claim 1 and a net configured for attachment to the goal frame.

* * * * *